US008408220B2

(12) United States Patent
Pei

(10) Patent No.: US 8,408,220 B2
(45) Date of Patent: Apr. 2, 2013

(54) CLEANING APPARATUS AND METHOD FOR CLEANING GLUE

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 862 days.

(21) Appl. No.: 12/477,136

(22) Filed: Jun. 3, 2009

(65) Prior Publication Data

US 2010/0037913 A1 Feb. 18, 2010

(30) Foreign Application Priority Data

Aug. 13, 2008 (CN) ..... 2008 1 0303741

(51) Int. Cl.
*B08B 3/14* (2006.01)

(52) U.S. Cl. ..... 134/73; 134/72

(58) Field of Classification Search ..... 134/4, 72, 134/73

See application file for complete search history.

(56) References Cited

U.S. PATENT DOCUMENTS 2,219,007 A * 10/1940 Dostal ..... 134/73
2,359,262 A * 9/1944 Trier et al. ..... 134/73
5,950,936 A * 9/1999 Bergart ..... 241/21
6,028,315 A * 2/2000 Bailey et al. ..... 250/455.11
6,383,329 B1 * 5/2002 Agarwala et al. ..... 156/706
6,557,564 B1 * 5/2003 Birang ..... 134/1.3
2007/0034240 A1 * 2/2007 Berner et al. ..... 134/110

FOREIGN PATENT DOCUMENTS

CN 1904652 A 1/2007

* cited by examiner

*Primary Examiner* — Michael Kornakov
*Assistant Examiner* — Douglas Lee
(74) *Attorney, Agent, or Firm* — Altis Law Group, Inc.

(57) ABSTRACT

A cleaning apparatus includes a heating device, a freezing device, and a conveying belt. The heating device includes a hot water source and a hot water container. The hot water container includes an exit shutter and defines a water inlet and a water outlet. The hot water source being communicated to the hot water container via the water inlet. The freezing device includes an aerosol spray system and a freezing container. The spray system includes a spray head. The freezing container includes an entrance shutter. The spray head is received in the freezing container. The conveying belt extends into the hot water container via the exit shutter and into the freezing container via the entrance shutter and thereby bridges the hot water container and the freezing container.

9 Claims, 7 Drawing Sheets

CLEANING APPARATUS AND METHOD FOR CLEANING GLUE

BACKGROUND

1. Technical Field

The present disclosure relates to a cleaning apparatus and method for cleaning glue.

2. Description of Related Art

In manufacturing of lenses, lenses are bonded to machine tools using glue to facilitate various manufacturing processes. After the manufacturing processes, the glue is remained on the lenses, degrading optical quality of the lenses. To solve this problem, currently, the lenses are cleaned using hot water after the manufacturing processes. However, result of such cleaning effect is not good.

Therefore, it is desirable to provide a cleaning apparatus and method, which can overcome the above-mentioned problems.

DETAILED DESCRIPTION

Figure 1:
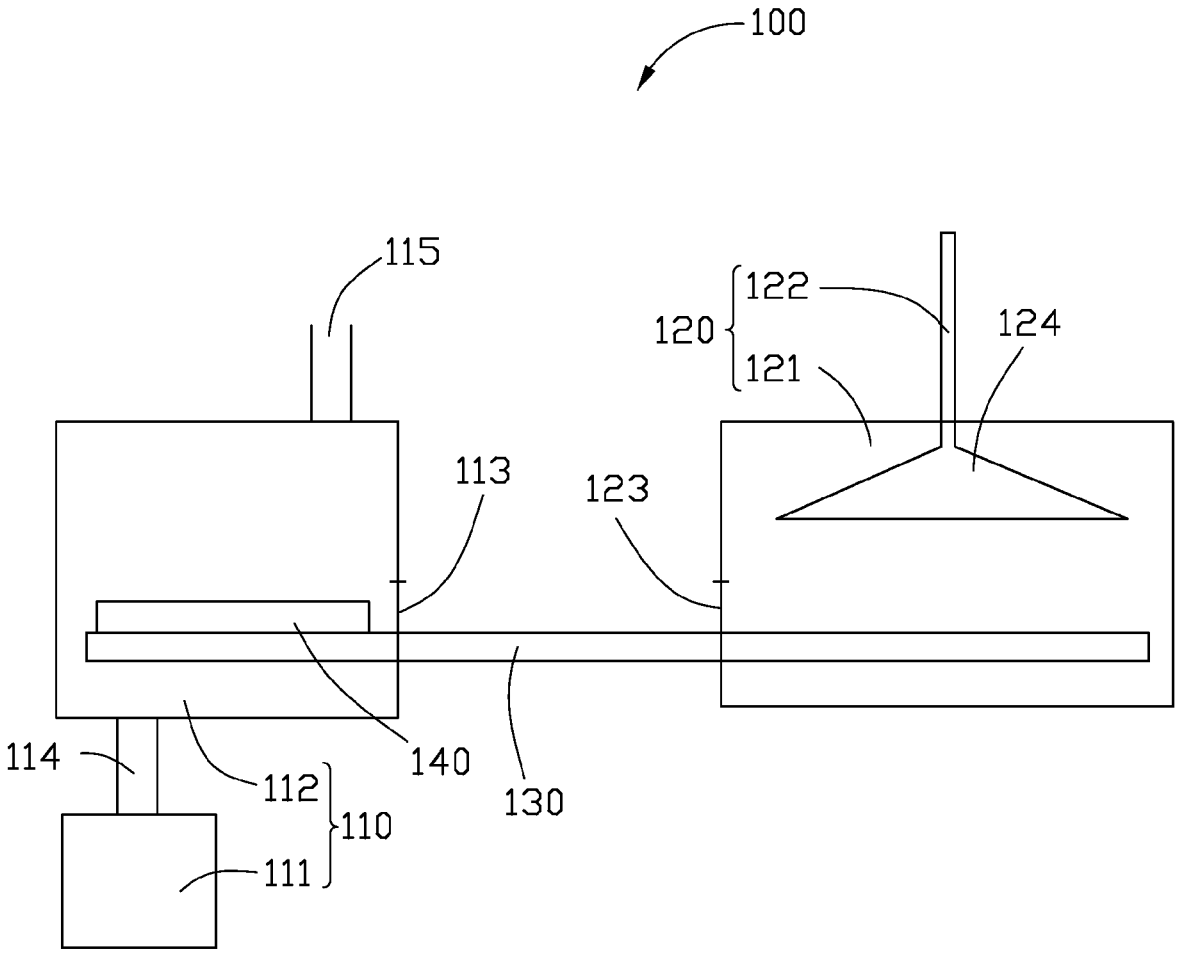
FIG. 1 is a schematic view of a cleaning apparatus, according to an exemplary embodiment.

Referring to FIG. 1, a cleaning apparatus 100, according to an exemplary embodiment, includes a heating device 110, a freezing device 120, a conveying belt 130, and a tray 140.

The heating device 110 includes a hot water source 111 and a hot water container 112. The hot water container 112 is a cuboid in shape and includes an exit shutter 113 embedded in a sidewall thereof. In addition, the hot water container 112 defines a water inlet 114 at one side beneath the conveying belt 130 and a water outlet 115 at the opposite side above the tray 140. The hot water source 111 communicates with the hot water container 112 via the water inlet 114.

The freezing device 120 includes a freezing container 121 and an aerosol spray system 122. The freezing container 121 is a cuboid in shape and includes an entrance shutter 123 embedded in a sidewall thereof. The aerosol spray kit 122 includes a spray head 124. The spray head 124 is received in the freezing container 121 and suspended to one end of the chamber 121, aiming at the conveying belt 130.

The conveying belt 130 extends into the hot water container 112 via the exit shutter 113 and into the freezing container 121 via the entrance shutter 123, thereby bridging the hot water container 112 and the freezing container 121.

The tray 140 is placed on the conveying belt 130.

Figure 2:
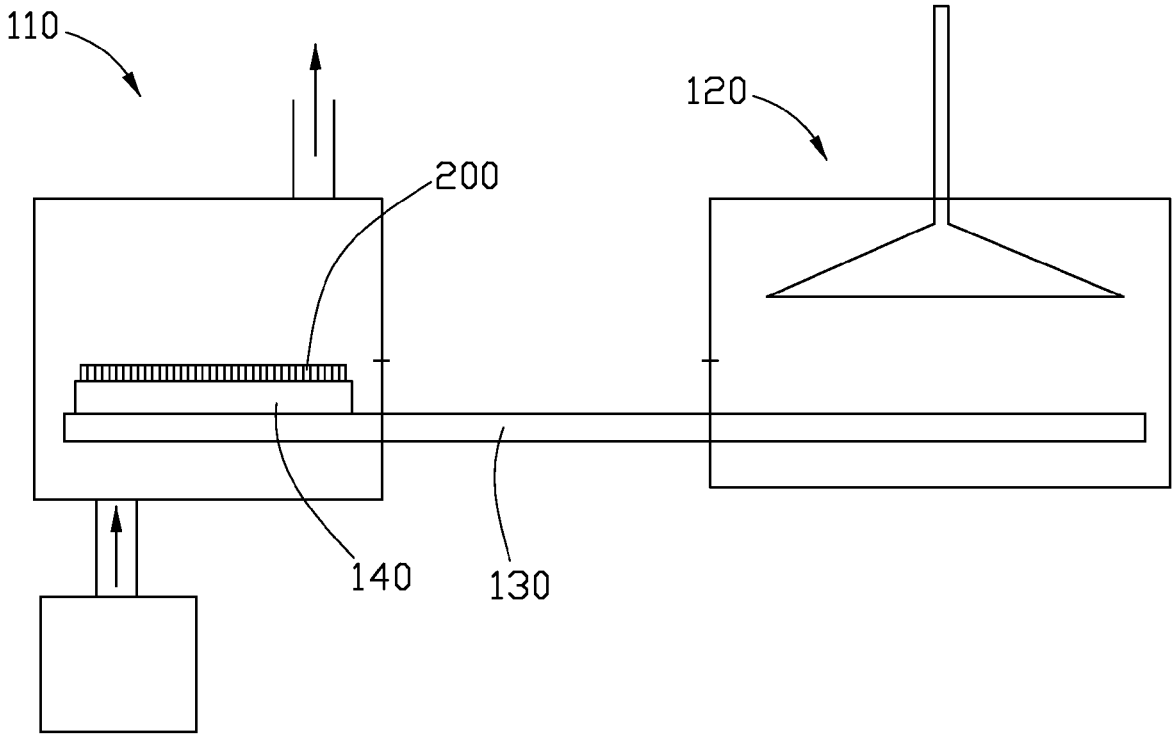
FIG. 2 is a schematic view of the cleaning apparatus of FIG. 1, which carries out a heating process.
Figure 4A:
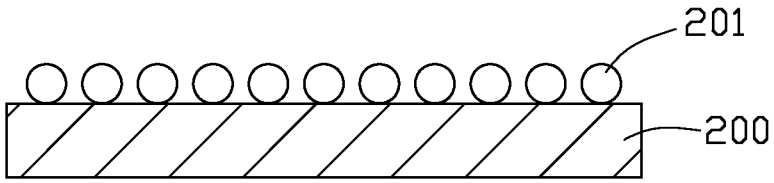
FIGS. 4A-4D are schematic views showing successive stages of a cleaning method, according to another exemplary embodiment.

In operation, also referring to FIG. 2, optical element(s) 200, such as lenses, are firstly placed on the tray 140. Also referring to FIG. 4A, commonly, in manufacturing of the optical element(s) 200, the optical element(s) 200 are bonded to machine tools (not shown) using glue 201 to facilitate manufacturing processes. After the manufacturing processes, the glue 201 is remained on the optical element(s) 200 in a form of solid particle.

Figure 4B:
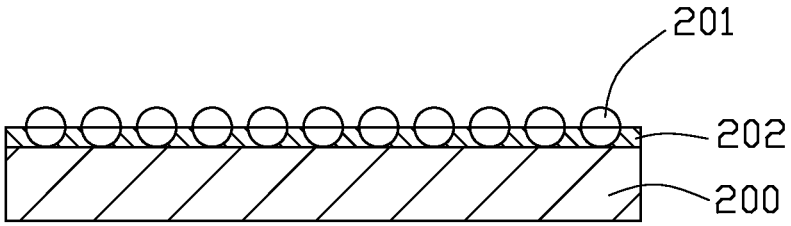

Secondly, the optical element(s) 200 are heated by the heating device 110 so that the glue 201 is changed into a solid-liquid state and a water layer 202 is formed in on the optical element(s) 200 and contacts the glue 201 (see FIG. 4B). In particular, initially, the exit shutter 113 is shut off and the heating device 110 is activated. Hot water is hydraulically provided by the hot water source 111 to the hot water container 112 via the water inlet 114 and flows from one end to the other towards the water outlet 15 of the hot water container 112. Such a flow direction can greatly increase contact effect between the hot water and the optical element(s) 200, accordingly increasing cleaning effect. Temperature of the hot water is beneficially about 60° C. This heating process typically lasts about 20 hours to achieve the above-described effect.

Thirdly, the exit shutter 113 and the entrance shutter 123 are opened. The conveying belt 130 is activated to transport the tray 140 on which the optical element(s) 200 are carried to the freezing container 120.

Figure 3:
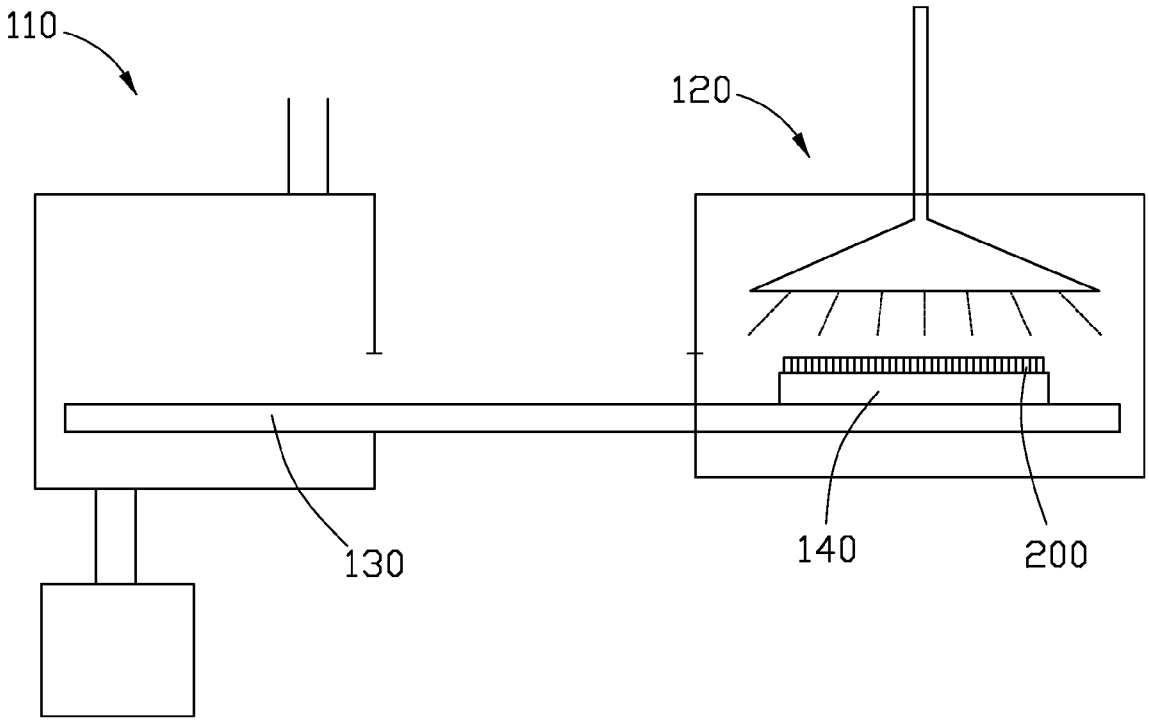
FIG. 3 is a schematic view of the cleaning apparatus of FIG. 1, which carries out a freezing process.
Figure 4C:
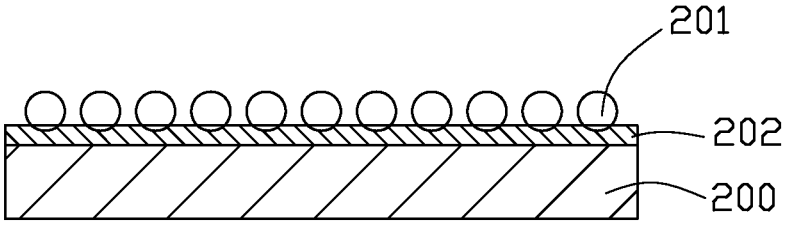
Figure 4D:
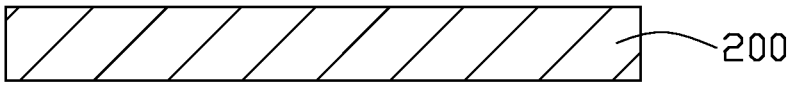

Fourthly, referring to FIG. 3, the optical element(s) 200 are frozen by the freezing device 120 so that the water layer 202 is frozen into a solid state (i.e., ice) such that the glue is expelled and partitioned off from the optical element(s) 200 by the frozen water layer 202 (see FIG. 4C). In particular, initially, the entrance shutter 123 is shut off, and the freezing device 120 is activated. Liquefied gas is provided by the aerosol spray kit 122 and sprayed by the spray head 124 to cool down the freezing container 121 to about −40° C. This freezing process typically lasts about 20 hours. During the freezing of the water layer 202, due to condensing force of the water layer 202, the glue 201 is expelled, i.e., separated, away from the optical element(s) 200.

Finally, the optical element(s) 200 are taken out of the freezing container 121 and are washed to dissolve the frozen water layer 202, thereby removing the glue 201 (see FIG. 4B).

It should be mentioned that above-described condition parameters such as temperatures 60° C. and −40° C., and lasting time 20 hours are prescribed and therefore are not limited to this embodiment.

It also should be mentioned that the heating device 110 and the freezing device 120 are not limited to this embodiment. For the heating device, any device which can heat the optical element(s) 200 to the required state can be used. For the freezing device, any device which can freeze the optical element(s) 200 to the required state can be used.

While various exemplary and preferred embodiments have been described, it is to be understood that the invention is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A cleaning apparatus comprising:

a heating device comprising a hot water source and a hot water container, the hot water container comprising an exit shutter and defining a water inlet and a water outlet, the hot water source being communicated to the hot water container via the water inlet;

a freezing device comprising an aerosol spray system and a freezing container, the spray system comprising a spray head, the freezing container comprising an entrance shutter, the spray head being received in the freezing container; and a conveying belt extending into the hot water container via the exit shutter and extending into the freezing container via the entrance shutter, thereby bridging the hot water container and the freezing container;

wherein the hot water container is cuboid in shape and comprises a bottom plate and a top plate opposite to the bottom plate, the water inlet is defined at the bottom plate, the water outlet is defined at the top plate;

and wherein the exit shutter is embedded in a sidewall of the hot water container and connecting between the bottom plate and the top plate.

2. The cleaning apparatus of claim 1, wherein the freezing container is substantially a cuboid in shape.

3. The cleaning apparatus of claim 2, wherein the entrance shutter is embedded in a sidewall of the freezing container.

4. The cleaning apparatus of claim 2, wherein the spray head is suspended to one end of the freezing container and facing to the conveying belt.

5. The cleaning apparatus of claim 1, further comprising a tray, the tray being placed on the conveying belt.

6. A cleaning apparatus for cleaning glue remained on an optical element, the cleaning apparatus comprising:

a heating device configured for heating the optical element so that the glue is changed from a solid state to a solid-liquid state and a water layer is formed on the optical element and contacts the glue;

a freezing device configured for freezing the optical element so that the water layer is frozen into a solid state such that the glue is expelled and partitioned off from the optical element by the frozen water layer; and a conveying belt for transporting the optical element from the heating device to the freezing device;

wherein the heating device comprises a hot water source and a hot water container, the hot water container comprising an exit shutter and defines a water inlet and a water outlet, the hot water source being communicated to the hot water container via the water inlet;

wherein the hot water container is cuboid in shape and comprises a bottom plate and a top plate opposite to the bottom plate, the water inlet is defined at the bottom plate, the water outlet is defined at the top plate; and wherein the exit shutter is embedded in a sidewall of the hot water container and connecting between the bottom plate and the top plate.

7. The cleaning apparatus of claim 6, wherein the water inlet is defined at one side of the hot water container beneath the conveying belt, the water out let is defined at the opposite side of the hot water container above the conveying belt.

8. The cleaning apparatus of claim 6, wherein the freezing device comprises an aerosol spray system and a freezing container, the spray system comprising a spray head, the spray head being received in the freezing container.

9. The cleaning apparatus of claim 6, further comprising a tray, the tray being placed on the conveying belt and being configured for holding the optical element.

* * * * *